US008246014B2

(12) United States Patent
Jien

(10) Patent No.: US 8,246,014 B2
(45) Date of Patent: Aug. 21, 2012

(54) WATER GATE RAIL HINGE AND LATCH

(75) Inventor: Lee-Wen Jien, Daliao Township, Kaohsiung County (TW)

(73) Assignee: Quinn Marine Hardware Co., Ltd, Kaohsiung County (TW)

( * ) Notice: Subject to any disclaimer, the term of this patent is extended or adjusted under 35 U.S.C. 154(b) by 323 days.

(21) Appl. No.: 12/690,926

(22) Filed: Jan. 20, 2010

(65) Prior Publication Data

US 2011/0173777 A1 Jul. 21, 2011

(51) Int. Cl.
*E04H 17/00* (2006.01)

(52) U.S. Cl. ..... 256/73; 256/59

(58) Field of Classification Search ..... 256/59, 256/73, 65.15; 16/357, 358, 361; 49/49, 49/394, 398

See application file for complete search history.

(56) References Cited

U.S. PATENT DOCUMENTS

| | | | | | |
|---|---|---|---|---|---|
| 880,697 | A * | 3/1908 | Soss | 16/357 |
| 2,518,207 | A * | 8/1950 | Wagner | 292/175 |
| 3,209,390 | A * | 10/1965 | Bassan | 16/358 |
| 3,881,221 | A * | 5/1975 | Schmidt | 16/361 |
| 4,398,840 | A * | 8/1983 | French | 256/73 |
| 4,780,929 | A * | 11/1988 | Burns et al. | 16/358 |
| 6,565,069 | B2 * | 5/2003 | Morris | 256/73 |
| 2005/0199868 | A1 * | 9/2005 | Morris | 256/73 |

* cited by examiner

*Primary Examiner* — Michael P Ferguson
(74) *Attorney, Agent, or Firm* — Chun-Ming Shih

(57) ABSTRACT

A water gate rail hinge and latch includes a hinge unit, a hinge portion, a wooden rail unit, a connective unit and a moveable latch. The hinge unit includes a first portion and a second portion. The first portion is connected with a fixed wooden rail and the second portion is connected with a moveable wooden rail. The first portion and second portion are connected by the hinge portion, which includes several clockwise rotational pieces and several counterclockwise rotational pieces. The wooden rail unit includes the fixed wooden rail and the moveable wooden rail. With such design, the fixed wooden rail and the moveable wooden rail may be opened and closed.

6 Claims, 14 Drawing Sheets

WATER GATE RAIL HINGE AND LATCH

BACKGROUND OF THE INVENTION

1. Field of the Invention

The invention generally relates to the fastening structure. More particularly, the invention relates to hinge and latch that are used for water gate rail.

2. Description of the Prior Art

A boat usually has rails on the peripheries of its deck for the safety of the people on board. Most of rails are made of wood, such as teak; some rails are made of metal, such as stainless steel. Teak has many advantages:

1. Containing special oil to keep moisture, bugs, ants and erosion off.
2. Strong, resilient and stable and having a small expansion coefficient.
3. Having many colors, such as yellow, brown and copper.
4. Having a naturally pleasant smell and is water-resistant.
5. The special oil disappears after long exposure to sunlight. The color of teak lasts for a long time and its color becomes more beautiful as it ages.

In light of the above, we can see that teak would be a preferred choice for a boat and rails. Rails are used to prevent people from accidental fall into the sea. A section without rail is often found on a boat and this may be potentially dangerous. Therefore, products with hinge design may be found on the market to enhance safety. However, the components of such products are not hidden; they do not have a nice appearance and the connective parts are easily damaged. On the other hand, the use of a hidden type hinge to connect the rails would have a nice appearance and the latch structure is not easily damaged because it is hidden. Also, the latch is used to secure the overall structure.

From the above, we can see that the products of the prior art have many disadvantages and drawbacks and need to be improved.

To eliminate the disadvantages of the products of the prior art, the inventor has put a lot of effort into the subject and has successfully come up with the water gate rail hinge and latch of the present invention.

SUMMARY OF THE INVENTION

An object of the present invention is to provide a water gate rail hinge and latch that may be opened and is structurally strong and stable.

Another object of the present invention is to provide a water gate rail hinge and latch in which the hinge structure is hidden so that the hinge and latch has a neat and nice appearance.

A third object of the present invention is to provide a water gate rail hinge and latch in which its latch structure is actuated by a spring to keep the fixed wooden rail and the moveable wooden rail in a locked position.

To reach these objects, the water gate rail hinge and latch of the present invention is disclosed. The water gate rail hinge and latch of the present invention comprises a hinge unit 1, a hinge portion 5, a wooden rail unit 4, a connective unit 3 and a moveable latch 2. The hinge unit 1 comprises a first portion 11 and a second portion 12. The first portion 11 is connected with a fixed wooden rail 42 and the second portion 12 is connected with a moveable wooden rail 41. The first portion 11 and second portion 12 are connected by the hinge portion 5, which includes several clockwise rotational pieces 53 and several counterclockwise rotational pieces 52. The pieces 52 and 53 are arranged in an alternating manner. The wooden rail unit 4 includes the fixed wooden rail 42 and the moveable wooden rail 41. One end of the moveable wooden rail 41 is connected with moveable latch 2. The connective unit 3 (corresponding to the moveable latch) is disposed on the fixed wooden rail 42. With such design, the fixed wooden rail 42 and the moveable wooden rail 41 may be may be opened and closed.

DETAILED DESCRIPTION OF THE PREFERRED EMBODIMENTS

Figure 1:
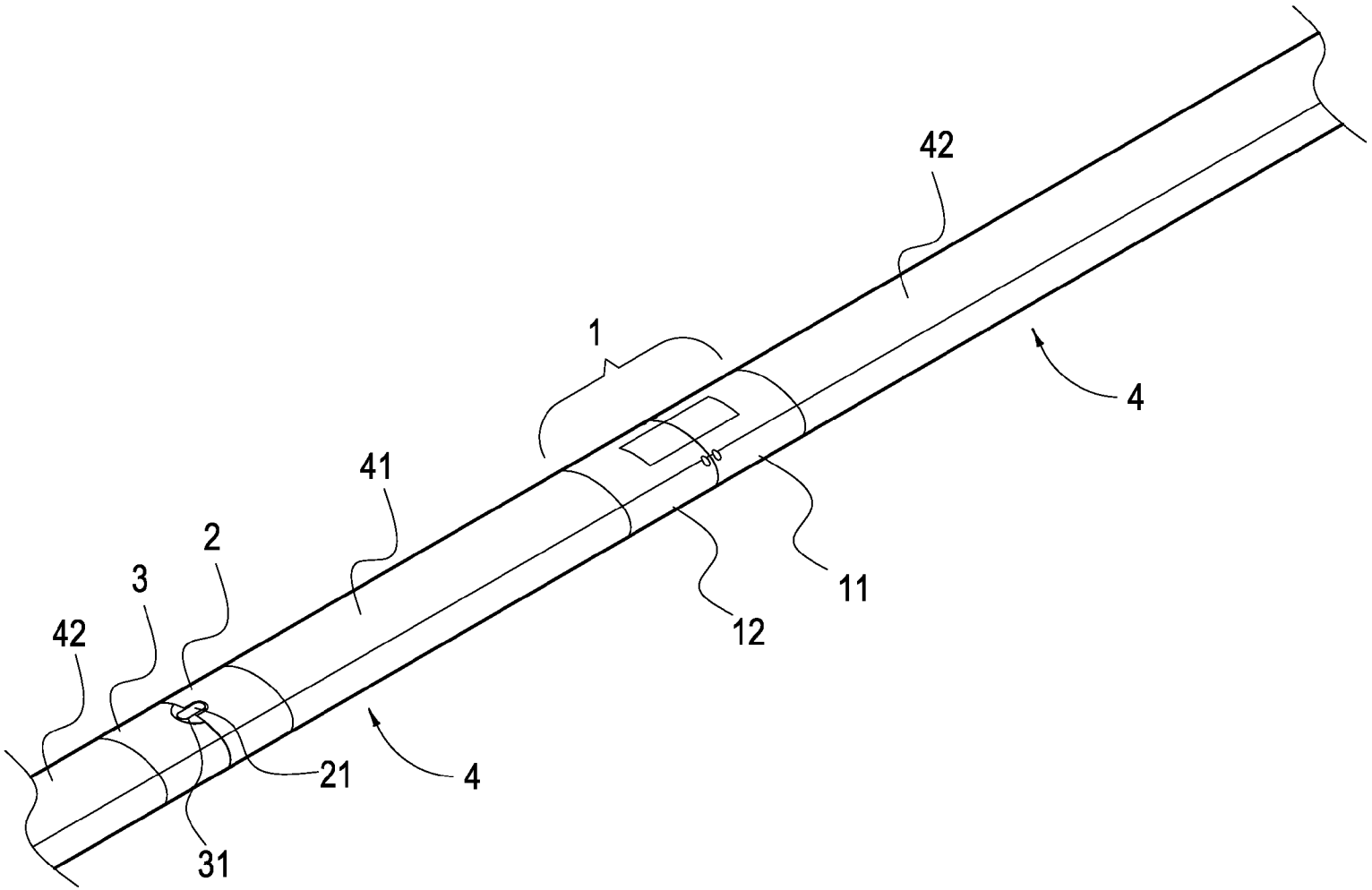
FIG. 1 is a perspective view illustrating the hinge and latch of the present invention.
Figure 2:
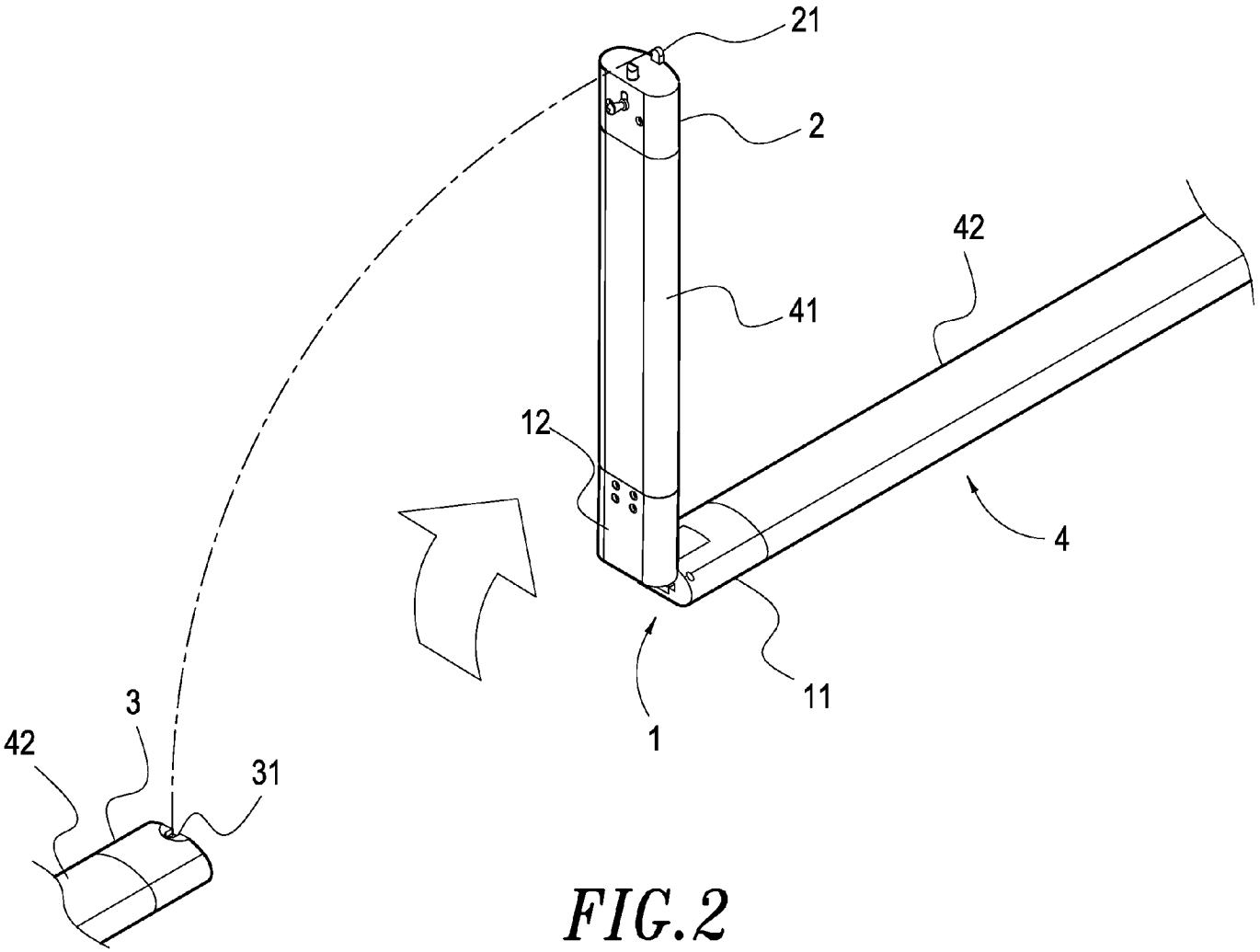
FIG. 2 is a perspective view illustrating that the hinge and latch of the present invention is opened.
Figure 3A:
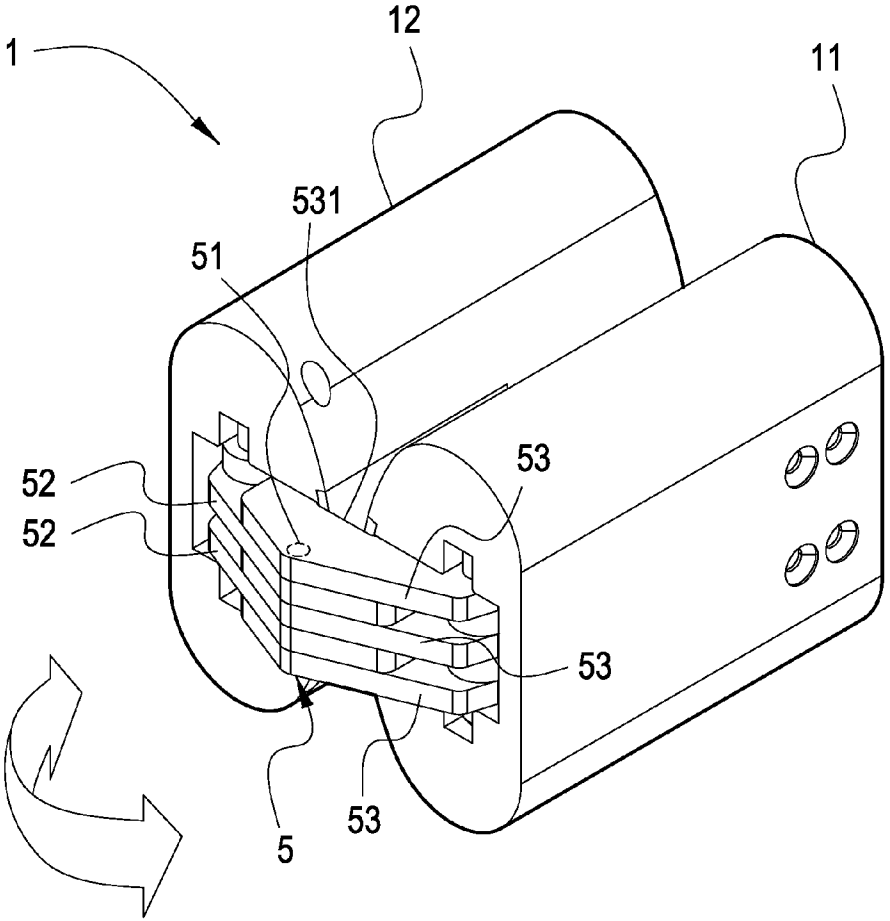
FIG. 3A is a perspective view illustrating the hinge portion of the hinge and latch of the present invention in an opened condition.

Please refer to FIGS. 1 and 2, which illustrate the water gate rail hinge and latch of the present invention. The water gate rail hinge and latch of the present invention comprises a hinge unit 1, a hinge portion 5 (as illustrated in FIG. 3), a wooden rail unit 4, a connective unit 3 and a moveable latch 2. The hinge unit 1 includes a first portion 11 and a second portion 12. The first portion 11 is connected with a fixed wooden rail 42 and the second portion 12 is connected with a moveable wooden rail 41. The hinge unit 1 includes a hinge portion 5 (as illustrated in FIG. 3A). The wooden rail unit 4 includes the moveable wooden rail 41 and the fixed wooden rail 42. One end of the moveable wooden rail 41 is connected with the moveable latch 2. The connective unit 3 is disposed on the fixed wooden rail 42 near the moveable latch 2. When the moveable latch 2 is closed, a connective piece 21 is connected with a connective slot 31 of the connective unit 3.

Figure 3B:
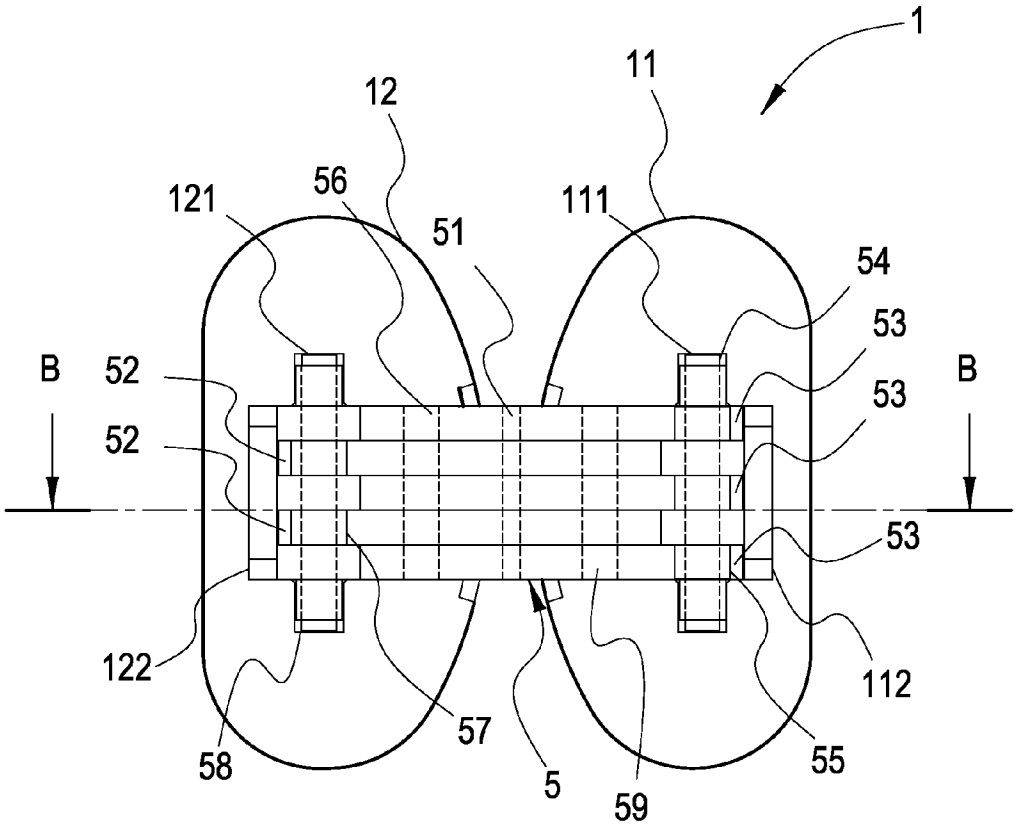
FIG. 3B is a front view illustrating the hinge portion of the hinge and latch of the present invention in an opened condition.
Figure 3C:
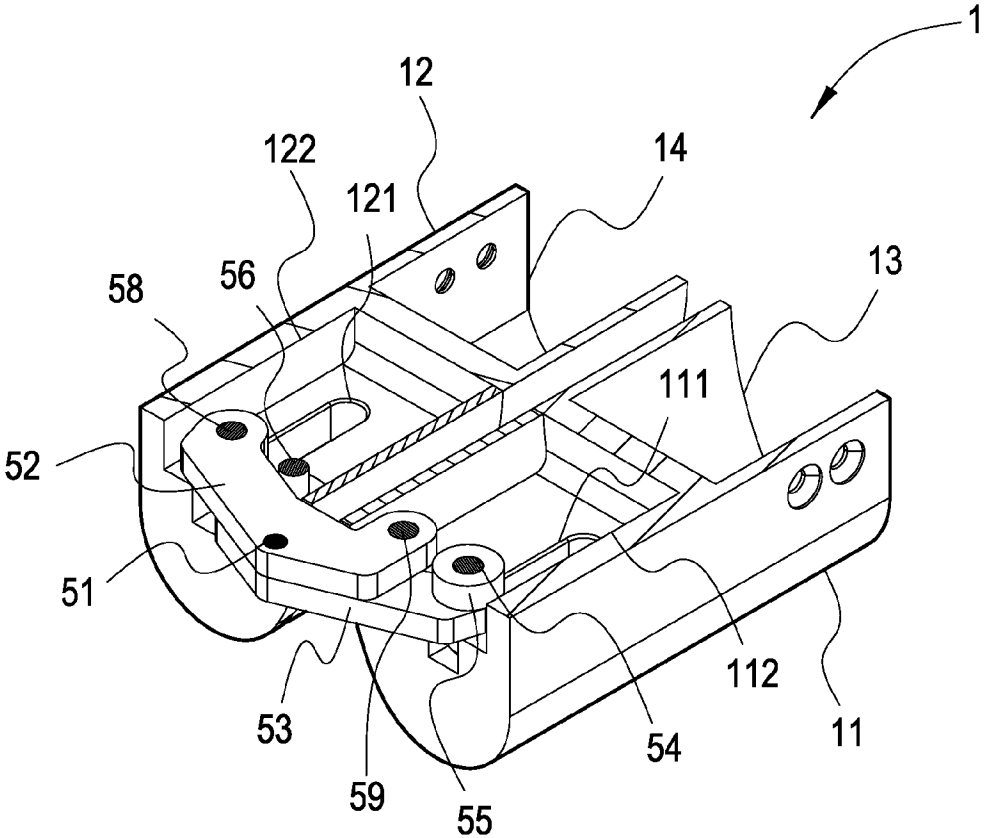
FIG. 3C is a sectional view illustrating the hinge portion of the hinge and latch of the present invention in an opened condition along line B in FIG. 3B.
Figure 3D:
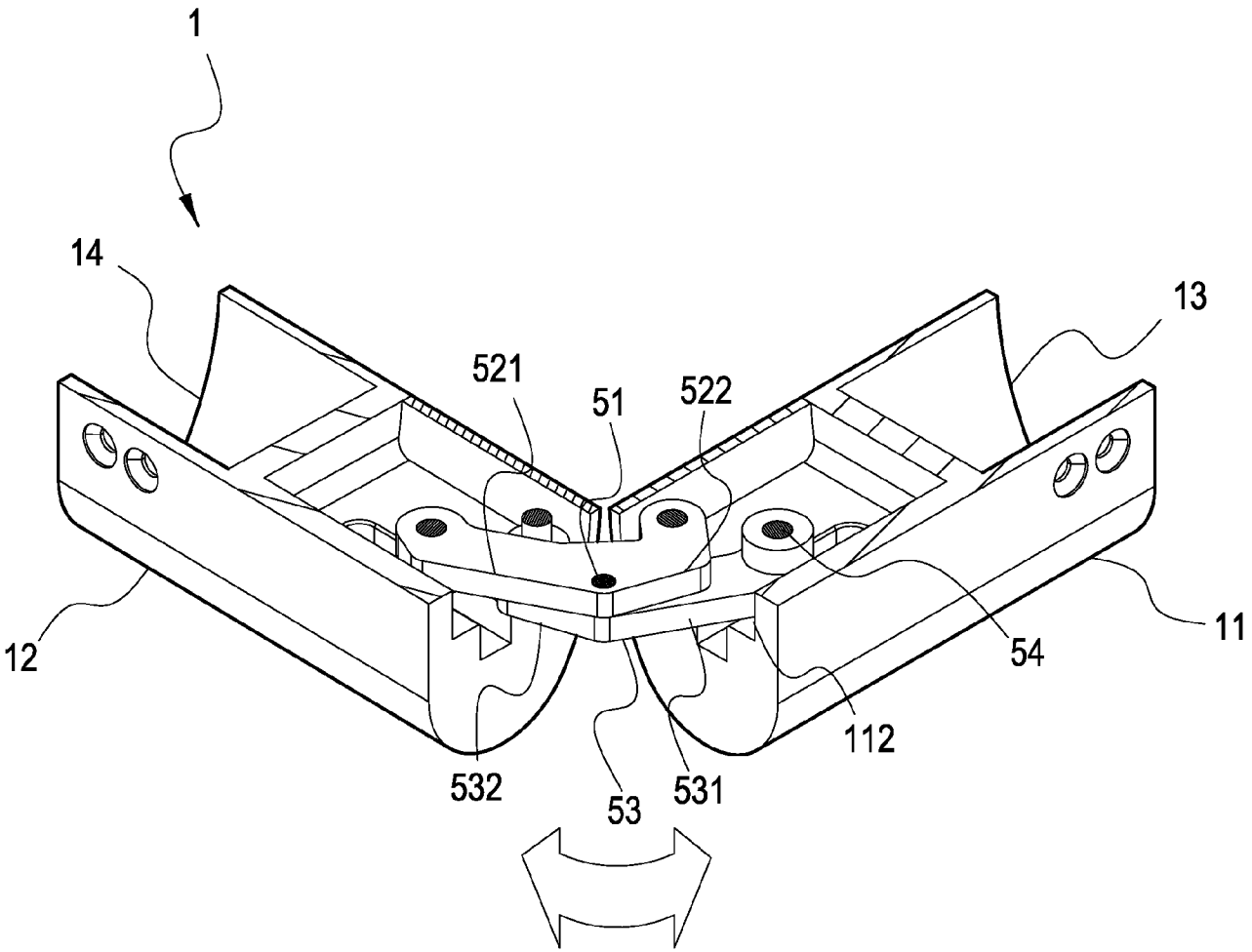
FIG. 3D is a sectional view illustrating the hinge portion of the hinge and latch of the present invention in a half-opened condition along line B in FIG. 3B.

Referring to FIG. 3A through FIG. 3C, the hinge unit 1 includes a first portion 11 and a second portion 12. A slot 112 and 122 is provided in the end portion of the first portion 11 and second portion 12. A first sliding slot 111 is connected with the slot 112 and a second sliding slot 121 is connected with the slot 122. The other end of the first portion 11 has a connective portion 13 and the other end of the second portion 12 has a connective portion 14. The first portion 11 and second portion 12 are connected by the hinge portion 5, which includes several clockwise rotational pieces 53 and several counterclockwise rotational pieces 52. The pieces 52 and 53 are arranged in an alternating manner. There are gaps between them and several supporting pieces 55 and 57 are disposed in the gaps. The supporting pieces 55 correspond to a first sliding pin 54 and the supporting pieces 57 correspond to a second sliding pin 58. The supporting pieces 55 and 57 provide support to the clockwise rotational pieces 53 and counterclockwise rotational pieces 52. Each clockwise rotational piece 53 and counterclockwise rotational piece 52 has a longer section 531 and 521 and a shorter section 532 and 522. The longer section and the shorter section form an angle. A connective pin 51 is inserted through the clockwise rotational pieces 53 and counterclockwise rotational pieces 52 and allows the clockwise rotational pieces 53 and counterclockwise rotational pieces 52 to rotate around the connective pin 51. The first sliding pin 54 is disposed in the longer section 531 of the clockwise rotational pieces 53. The top and bottom of the first sliding pin 54 are connected with the first sliding slot 111. The second sliding pin 58 is disposed in the longer section 521 of the clockwise rotational pieces 52. The top and bottom of the second sliding pin 58 are connected with the second sliding slot 121.

Figure 4A:
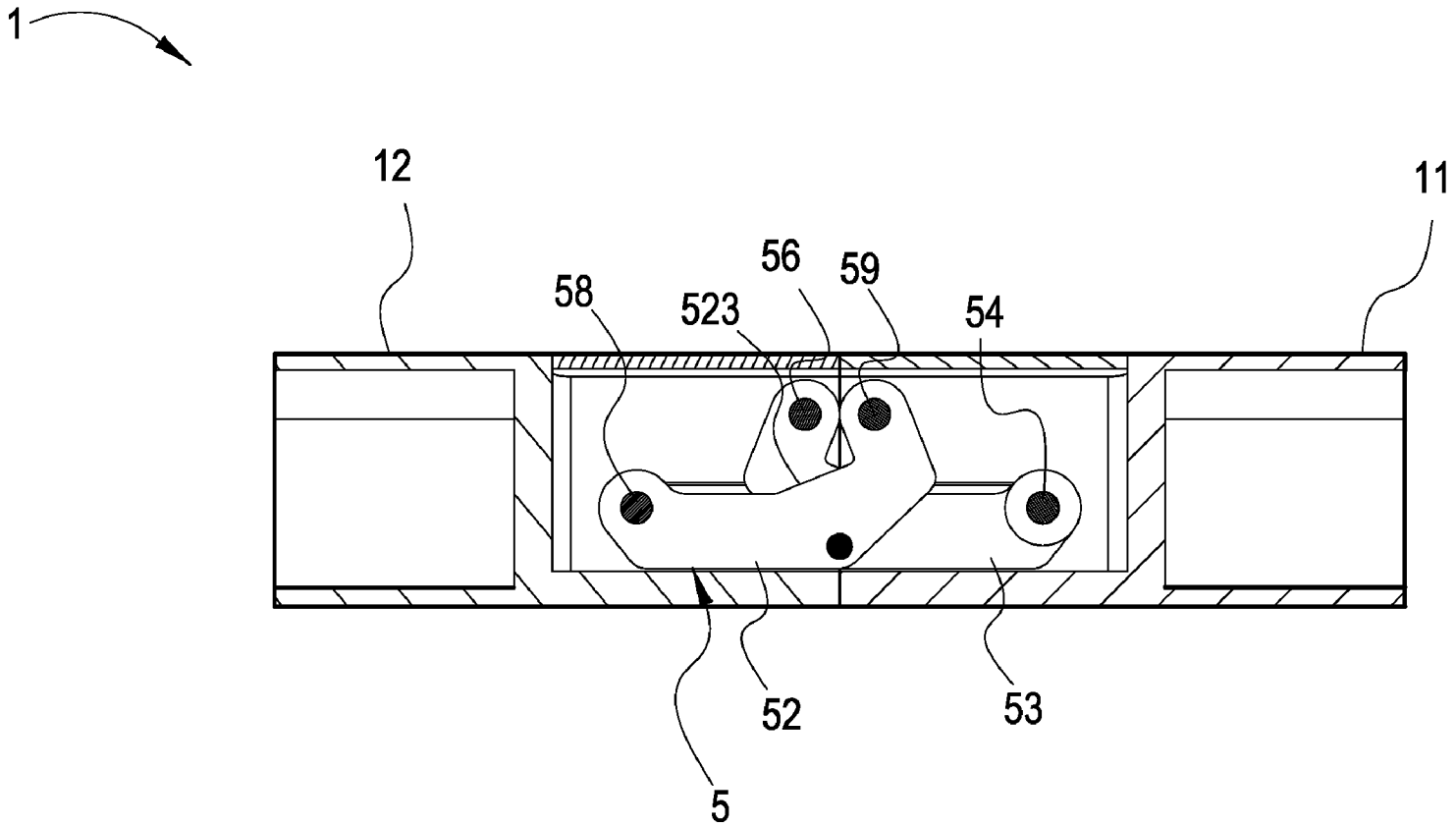
FIGS. 4A, 4B and 4C are sectional views illustrating how the hinge portion of the hinge and latch of the present invention is opened in a continuous manner.
Figure 4B:
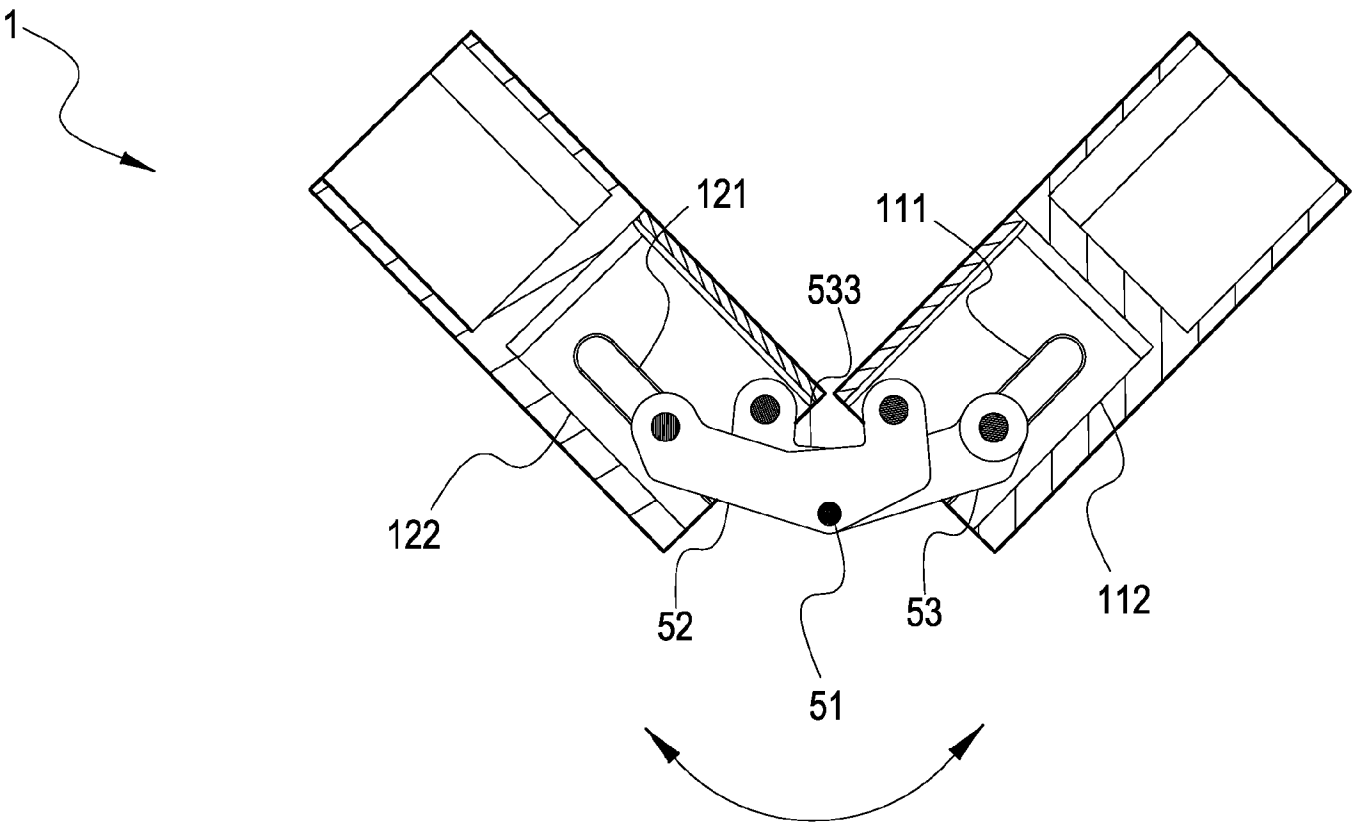
Figure 4C:
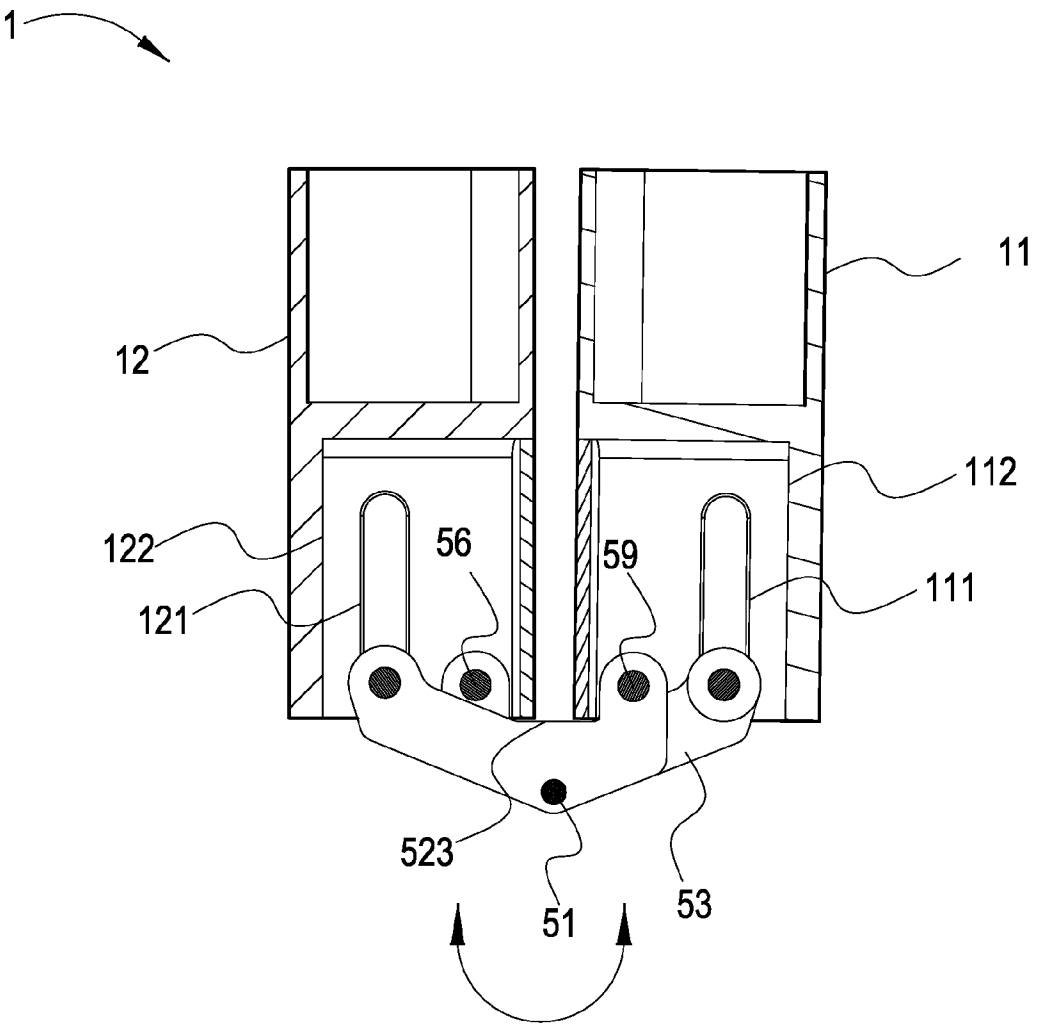

Referring to FIG. 4A through FIG. 4C, the first portion 11 and second portion 12 are driven by the clockwise rotational pieces 53 and the counterclockwise rotational pieces 52. When the hinge unit 1 is opened, the clockwise rotational pieces 53 rotate around the first sliding pin 54 and gradually open according to the positioning pin 59. When the first sliding pin 54 reaches the opening of the first sliding slot 111, the limiting side 533 of the clockwise rotational pieces 53 presses against a surface of the first portion 11. Now, the position of the clockwise rotational pieces 53 is secured. Similarly, the counterclockwise rotational pieces 52 rotate around the second sliding pin 58 and gradually open according to the positioning pin 56. When the second sliding pin 58 reaches the opening of the first sliding slot 111, the limiting side 523 of the counterclockwise rotational pieces 52 presses against a surface of the first portion 11. Now, the position of the counterclockwise rotational pieces 53 is secured. When the hinge unit 1 is closed, the clockwise pieces 53 and the counterclockwise pieces 52 are stored in the slots 112 and 122 so that the hinge portion 5 is hidden to enhance the appearance. With such structure of the hinge portion 5, the first portion 11 and second portion 12 may be opened and closed in the range of 180 degree.

Referring to 5A and 5B, the moveable latch 2 has a connective portion 27 on one side and has a through hole 222 on the other side. The connective piece 21 is disposed on top of the moveable latch 2 and a hollow portion 22 is provided inside the mobile latch 2. The bottom of the hollow portion 22 is connected with the bottom of the moveable latch 2. A connective slot 221 is provided. One end the hollow portion 22 is in communication with the through hole 222 so that a fixing pin 24 may pass through. A connective hole 242 is provided on the surface of the fixing pin 24 and the other end forms a protruding portion 241 to hold a spring 25. A sealing piece 26 is used to seal off and fix the other end of the hollow portion 22. A piece 231 is provided on one end of a switch portion 23. The piece 231 is connected with the connective hole 242. A seat portion 232 forms the piece 231 and the motion of the seat portion 232 is limited by the connective slot 221. A protruding portion 233 forms above the seat portion 232 and the protruding portion 233 is disposed in the bottom of the moveable latch 2. Also, a connective portion 33 is provided on one end of the connective unit 3 and a fixing hole 32 is provided on the other end. A connective slot 31 is provided on the connective piece 21.

Figure 5A:
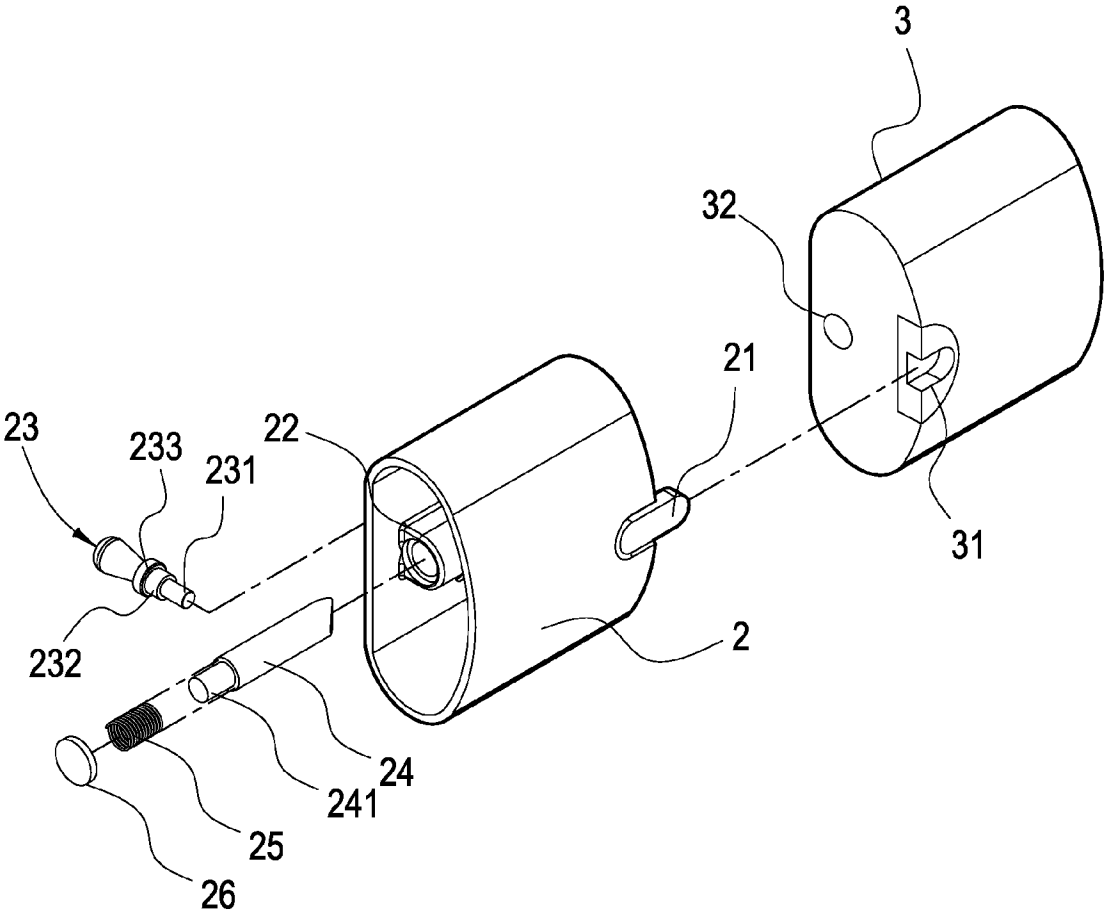
FIG. 5A is an exploded view illustrating the moveable latch and the elements of the connective unit 3.
Figure 5B:
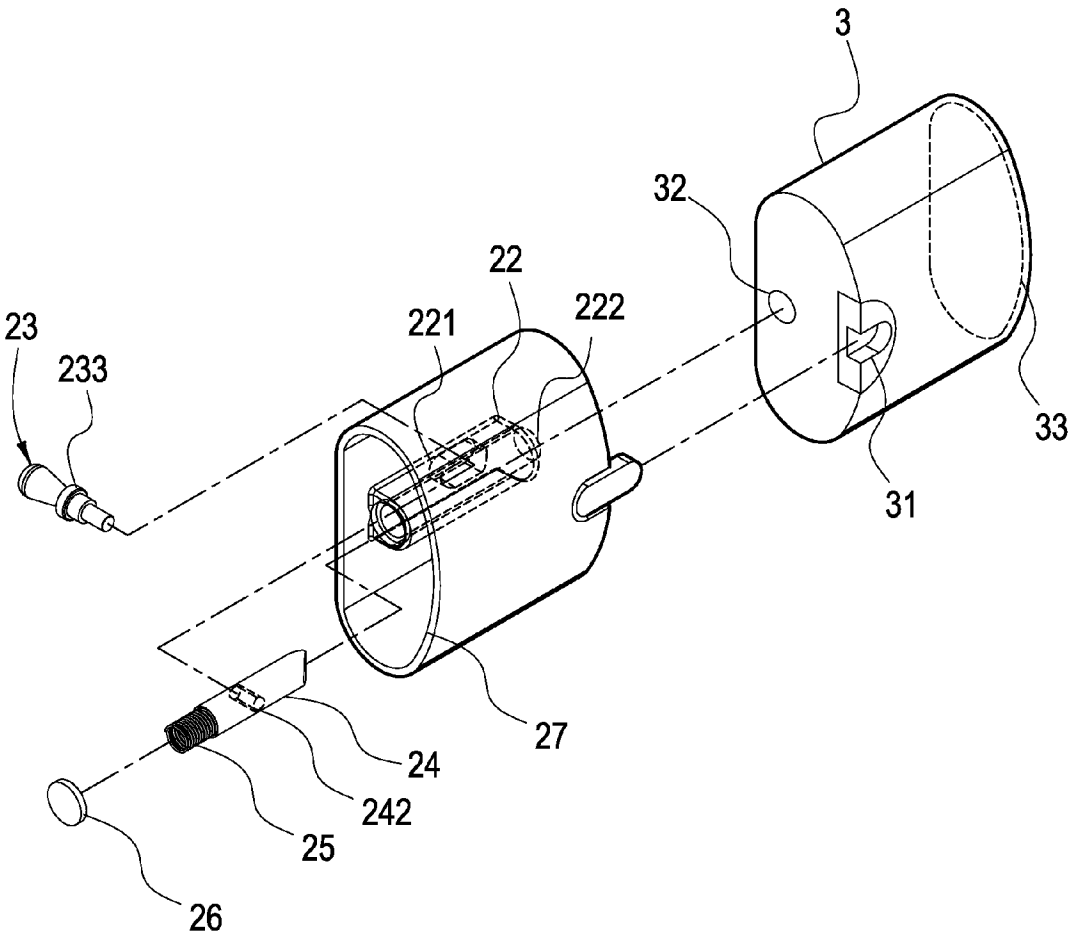
FIG. 5B is an exploded view illustrating the connective relations for the moveable latch and the elements of the connective unit.

Referring to FIGS. 5A, 6A, 6B and 6C, a switch portion 23 may move in the connective slot 221 in a limited manner. The piece 231 helps to move the fixing pin 24. Also, the spring 25 allows the fixing pin 24 to pass the through hole 222 to reach the fixing hole 32. The wooden rail unit 4 includes a moveable wooden rail 41 and a fixed wooden rail 42. The fixed wooden rail 42 is connected with the connective portion 13 (as illustrated in FIG. 3C). One end of the moveable wooden rail 41 is connected with the connective portion 14 (as illustrated in FIG. 3C). The other end of the moveable wooden rail 41 is connected with the connective portion 27 (as illustrated in FIG. 5B). The connective portion 33 (please see FIG. 5B) is disposed on the other section of the fixed wooden rail 42. When the moveable wooden rail 41 is opened, the piece 231 of the switch portion 23 can move the fixing pin 24 and the flexibility of the spring 25 may assist fixing pin 24 to disengage from the connective hole 32 to unlock the moveable wooden rail 41. Also, the connective piece 21 disengages from the connective slot 31. Now, the moveable wooden rail 41 may be fully opened.

Figure 6A:
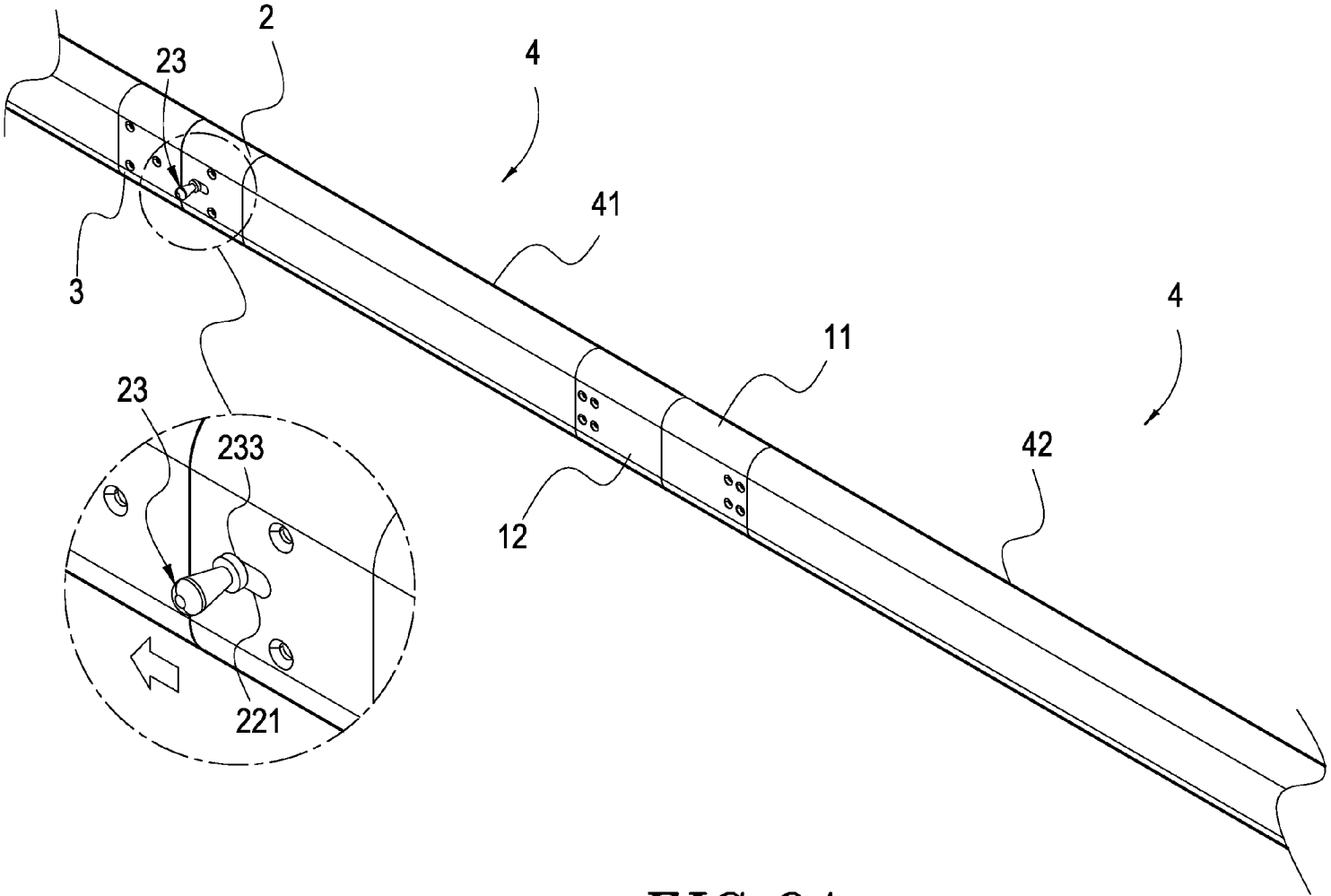
FIGS. 6A, 6B and 6C are three perspective views illustrating the continuous action of the switch portion to control and open the moveable latch.
Figure 6B:
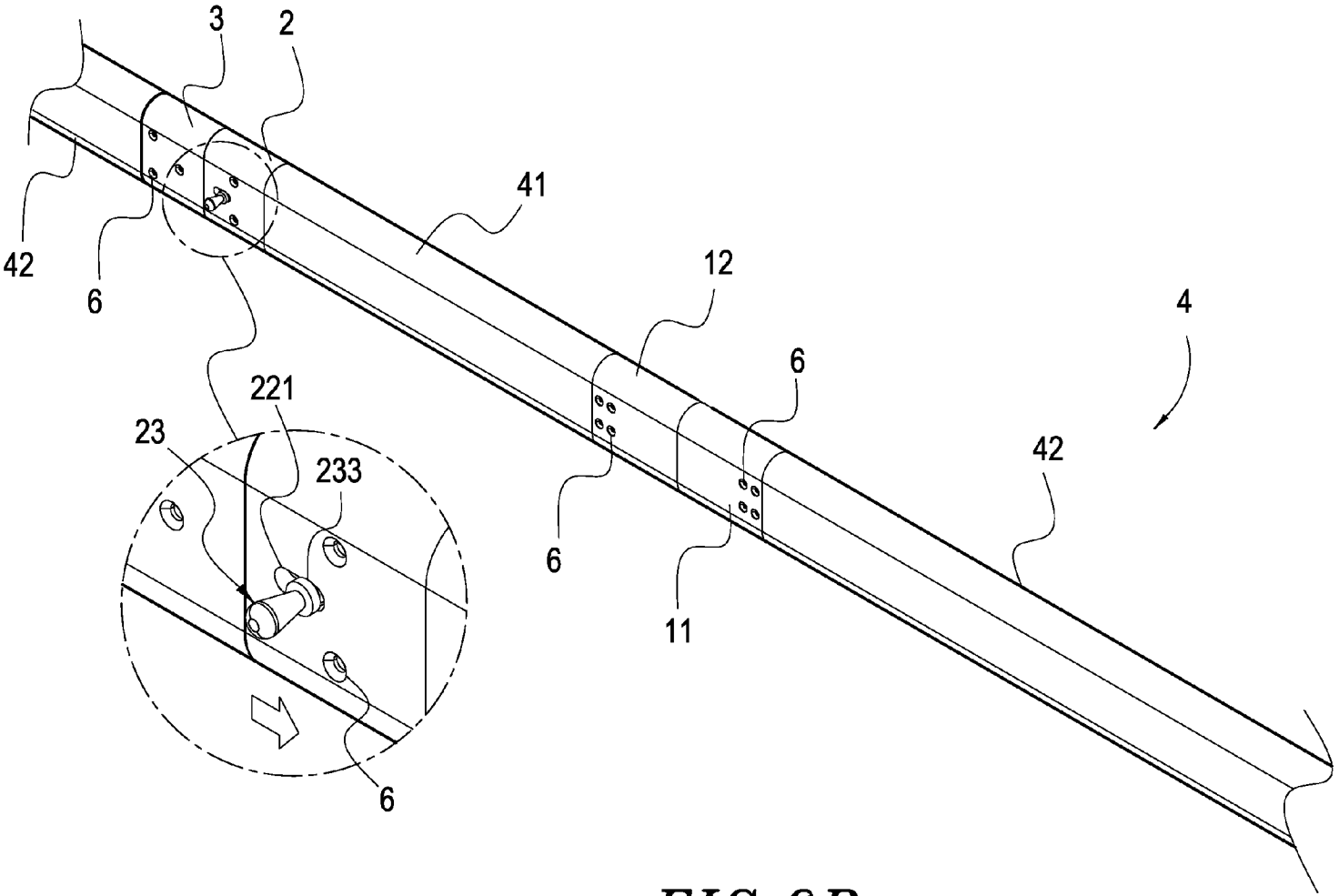
Figure 6C:
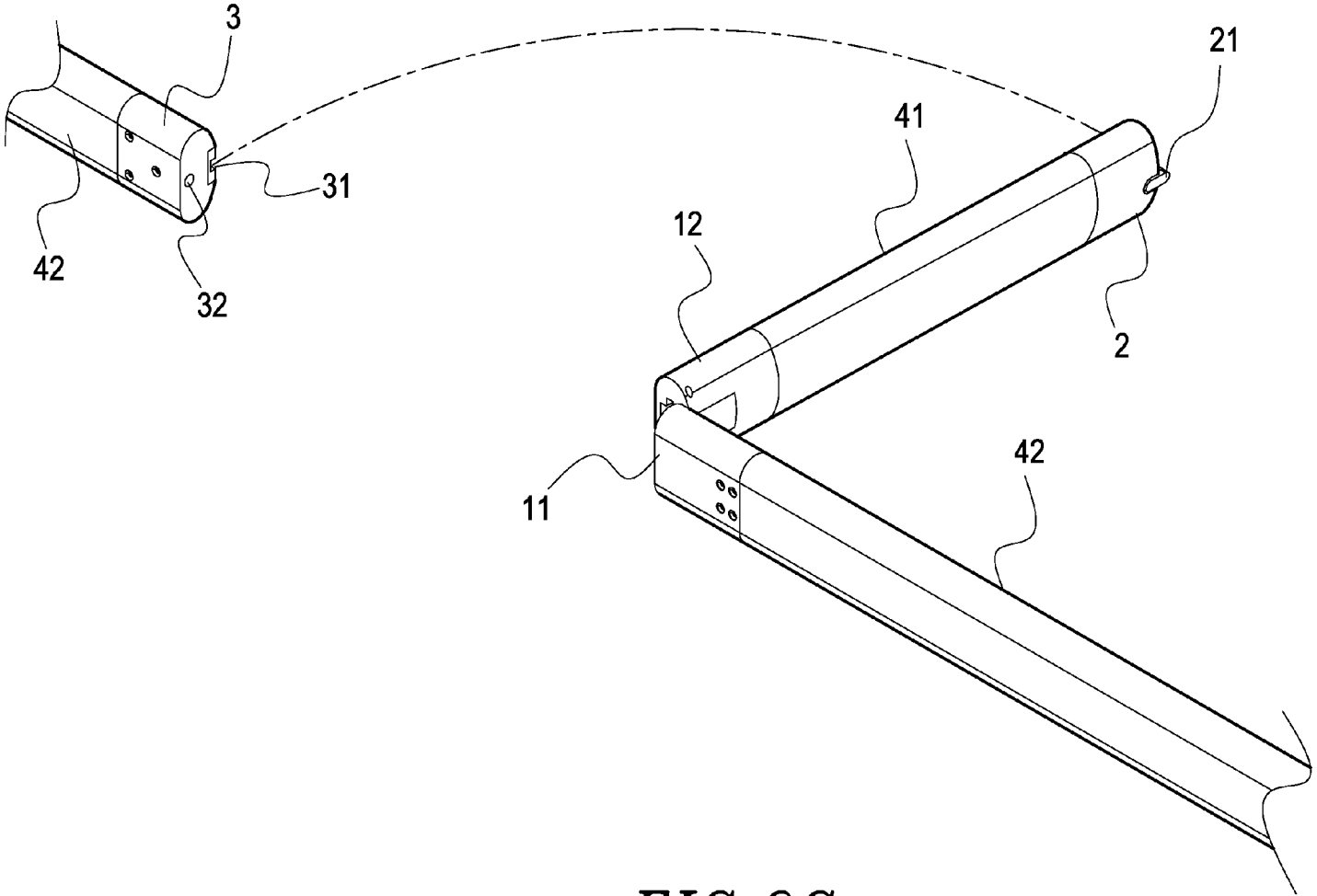

Referring to FIG. 6B, the bottoms of the first hinge portion 11, second hinge portion 12 and connective unit 3 have a set of connective holes 6. Fasteners (not shown in the drawing) may be used to be inserted into the holes 6 to strengthen their strength when they are connected with the moveable wooden rail 41 and the fixed wooden rail 42. Therefore, the strength and safety of the rails may be enhanced.

The wooden rails of the present invention may be teak or other type of wood. The hinge unit 1, moveable latch 2 and connective unit 3 may be made of stainless steel or other type of metal that is rigid, water-resistant and erosion-resistant.

In comparison to the prior art, the water gate rail hinge and latch of the present invention has the following advantages:

1. The water gate rail hinge and latch of the present invention is structurally strong and very stable and has enough strength in terms of connections.
2. All components are hidden inside. Therefore, the water gate rail hinge and latch of the present invention has a neat and nice appearance.
3. In the water gate rail hinge and latch of the present invention, its latch structure is actuated by a spring to keep the fixed wooden rail 42 and the moveable wooden rail 41 in a locked position.

Although a preferred embodiment of the present invention has been described in detail in the above, the preferred embodiment and the associated discussion and drawings are to be regarded in an illustrative manner rather than a restrictive manner. It will, however, be evident that various changes and modifications may be made thereunto without departing from the broader spirit and scope of the invention as set forth in the appended claims.

From the above, we can see that the water gate rail hinge and latch of the present invention meets the relevant patent requirements. It is hoped that the patent application will be approved.

What is claimed is:

1. A gate rail hinge and latch assembly, comprising:

a hinge unit, comprising a first portion and a second portion, wherein a first slot and a second slot are provided in an end portion of the first portion and second portion, respectively and a first sliding slot is disposed within a sidewall of the first slot and a second sliding slot is disposed within a sidewall of the second slot, and wherein the other end of the first portion has a first connective portion and the other end of the second portion has a second connective portion;

a hinge portion, comprising several clockwise rotational pieces and several counterclockwise rotational pieces, wherein the clockwise and the counterclockwise rotational pieces and are arranged in an alternating manner and each clockwise rotational piece and each counterclockwise rotational piece has a longer section and a shorter section and, wherein the longer section and the shorter section form an angle and a connective pin is inserted through the clockwise rotational pieces and counterclockwise rotational pieces so that the clockwise rotational pieces and counterclockwise rotational pieces are allowed to rotate around the connective pin, and wherein a first sliding pin is disposed in the longer section of each clockwise rotational piece and a top and a bottom of the first sliding pin are slidably connected with the first sliding slot, and wherein a second sliding pin is disposed in the longer section of each counterclockwise rotational piece and a top and a bottom of the second sliding pin are slidably connected with the second sliding slot, and wherein a first positioning pin is disposed in the shorter section of each clockwise rotational piece and a top and a bottom of the first positioning pin are fixedly connected with the second slot, and wherein a second positioning pin is disposed in the shorter section of each counterclockwise rotational piece and a top and a bottom of the second positioning pin are fixedly connected with the first slot so that when the first and second portions of the hinge unit are pivoted relative to one another to an opened position, the clockwise rotational pieces rotate around the first sliding pin and gradually open until the counterclockwise rotational pieces abut the first positioning pin, and the counterclockwise rotational pieces rotate around the second sliding pin and gradually open until the clockwise rotational pieces abut the second positioning pin;

a moveable latch unit, wherein the moveable latch unit has a third connective portion on one side and has a through hole formed in an end wall of the other side which defines an interior cavity of the latch unit, and wherein a connective piece is disposed on top of the moveable latch unit adjacent the end wall and a seat with a hollow portion is provided inside the moveable latch unit, wherein a bottom wall of the seat hollow portion is connected with a bottom wall of the interior cavity of the moveable latch unit and a first connective slot extends through the bottom walls, wherein one end of the hollow portion is in communication with the through hole so that a fixing pin slidably passes through, and wherein a first connective hole is provided on the surface of the fixing pin and an end of the fixing pin forms a first protruding portion holding a spring, and wherein a sealing piece abuts an end of the spring and is used to seal off and fix the other end of the hollow portion;

a switch portion, wherein a protruding piece is formed at a lower portion of the switch portion and is connected with the connective hole of the fixing pin, wherein a seat portion is formed above the protruding piece and slidably located in the first connective slot so that the motion of the seat portion is limited by the first connective slot, and wherein a second protruding portion is formed above the seat portion and the second protruding portion is disposed on an exterior of the bottom wall of the moveable latch unit;

a connective unit, wherein a fourth connective portion is disposed on one end of the connective unit and a fixing hole is disposed in an end wall of the other end of the connective unit, and wherein a second connective slot is disposed on top of the connective unit so as to correspondingly engage with the connective piece of the latch unit so that the spring pushes the fixing pin to pass through the through hole to reach the fixing hole; and a wooden rail unit, comprising a moveable wooden rail and first and second fixed wooden rails, wherein the first portion is connected with the first fixed wooden rail by the first connective portion and the second portion is connected with one end of the moveable wooden rail by the second connective portion, wherein the other end of the moveable wooden rail is connected with the moveable latch unit by the third connective portion and the connective unit is disposed on the second fixed wooden rail near the moveable latch unit by the fourth connective portion, or the other end of the moveable wooden rail is connected with the connective unit by the fourth connective portion and the moveable latch unit is disposed on the second fixed wooden rail near the moveable latch unit by the third connective portion, thereby under a pivotal engagement of the movable wooden rail and the first fixed wooden rail by the hinge portion, the movable wooden rail may be engaged with or disengaged from the second fixed wooden rail to provide a closed or an open state of a gate.

2. The gate rail hinge and latch assembly as in claim 1, wherein there are gaps between the clockwise and the counterclockwise rotational pieces and several supporting pieces are disposed on the first and second sliding pins in the gaps to support the clockwise rotational pieces and the counterclockwise rotational pieces, respectively.

3. The gate rail hinge and latch assembly as in claim 1, wherein a limiting side is disposed on each clockwise rotational piece to press against the first portion when the first sliding pin reaches an opening of the first sliding slot, and another limiting side is disposed on each counterclockwise rotational piece to press against the second portion when the second sliding pin reaches an opening of the second sliding slot.

4. The gate rail hinge and latch assembly as in claim 1, wherein the bottoms of the first portion and the second portion have a set of second connective holes.

5. The gate rail hinge and latch assembly as in claim 1, wherein a set of second connective holes is disposed in the bottom of the moveable latch unit.

6. The gate rail hinge and latch assembly as in claim 1, wherein a set of second connective holes is disposed in the bottom of the connective unit.

* * * * *